US010190546B2

(12) United States Patent
Yoshioka et al.

(10) Patent No.: US 10,190,546 B2
(45) Date of Patent: Jan. 29, 2019

(54) INTAKE MANIFOLD

(71) Applicant: AISAN KOGYO KABUSHIKI KAISHA, Obu-shi, Aichi-ken (JP)

(72) Inventors: Mamoru Yoshioka, Nagoya (JP); Masashi Takeda, Toyota (JP)

(73) Assignee: AISAN KOGYO KABUSHIKI KAISHA, Obu-shi (JP)

( * ) Notice: Subject to any disclaimer, the term of this patent is extended or adjusted under 35 U.S.C. 154(b) by 0 days.

(21) Appl. No.: 15/797,746

(22) Filed: Oct. 30, 2017

(65) Prior Publication Data

US 2018/0179999 A1 Jun. 28, 2018

(30) Foreign Application Priority Data

Dec. 26, 2016 (JP) ..... 2016-250805

(51) Int. Cl.

| | |
|---|---|
| ***F02M 35/104*** | (2006.01) |
| ***F02M 26/28*** | (2016.01) |
| ***F02M 35/10*** | (2006.01) |
| ***F01M 13/02*** | (2006.01) |
| ***F02M 26/20*** | (2016.01) |

(52) U.S. Cl.

CPC .... *F02M 35/10144* (2013.01); *F01M 13/022* (2013.01); *F02M 26/20* (2016.02); *F02M 26/28* (2016.02); *F02M 35/104* (2013.01); *F02M 35/10026* (2013.01); *F02M 35/10222* (2013.01)

(58) Field of Classification Search

CPC ..... F02M 35/104; F02M 35/10157; F02M 35/10222; F02M 35/10052; F02M 35/10268; F02M 35/10327; F02M 35/10091; F02M 35/10144; F02M 35/10026; F02M 26/23; F02M 26/21; F02M 26/04; F02M 26/20; F02M 26/22; F02M 26/19; F02M 26/28; F02M 26/11; F02M 26/17; F02B 29/0475; F02B 29/0437

See application file for complete search history.

(56) References Cited

U.S. PATENT DOCUMENTS 6,807,957 B2 * 10/2004 Ko ..... F02M 25/06 123/184.21
7,198,040 B2 * 4/2007 Noda ..... F02M 25/06 123/568.15

(Continued)

FOREIGN PATENT DOCUMENTS

JP H04-37255 Y2 9/1992
JP 2005-155448 A 6/2005

(Continued)

*Primary Examiner* — George C Jin
(74) *Attorney, Agent, or Firm* — Oliff PLC

(57) ABSTRACT

An intake manifold made of resin includes a surge tank, a plurality of branch pipes branching off from the surge tank, an EGR gas distribution part for distributing EGR gas to each of the branch pipes, and an EGR cooler for cooling EGR gas introduced into the EGR gas distribution part. The EGR cooler and the EGR gas distribution part are made of resin and provided adjacently and integrally. The EGR cooler includes a gas passage through which EGR gas flows and a water passage through which engine cooling water flows to cool the gas passage to allow the EGR gas to pass through the EGR cooler and then flow in the EGR gas distribution part.

9 Claims, 19 Drawing Sheets

(56) References Cited

U.S. PATENT DOCUMENTS

| | | | | |
|---|---|---|---|---|
| 2006/0191505 | A1* | 8/2006 | Doko | F02M 35/10039 123/184.59 |
| 2010/0199663 | A1* | 8/2010 | Marimbordes | F02B 29/0475 60/599 |
| 2010/0263637 | A1* | 10/2010 | Muller | F02B 29/0418 123/556 |
| 2013/0263797 | A1* | 10/2013 | Sugiura | F01P 3/00 123/41.01 |
| 2014/0190459 | A1 | 7/2014 | Horiuchi | |
| 2015/0027114 | A1* | 1/2015 | Ino | F02M 35/10268 60/599 |

FOREIGN PATENT DOCUMENTS

| | | | |
|---|---|---|---|
| JP | 2013-053558 | A | 3/2013 |
| JP | 2018-044518 | A | 3/2018 |

* cited by examiner

INTAKE MANIFOLD

CROSS-REFERENCE TO RELATED APPLICATIONS

This application is based upon and claims the benefit of priority from the prior Japanese Patent Application No. 2016-250805 filed on Dec. 26, 2016, the entire contents of which are incorporated herein by reference.

BACKGROUND

Technical Field

This disclosure relates to an intake manifold provided with a plurality of branch pipes for distributing intake air to a plurality of cylinders of an engine and, more particularly, to an intake manifold provided with an EGR gas distribution part for distributing EGR gas to each of the branch pipes.

Related Art

As the above type of technique, there has conventionally been known an intake manifold disclosed in Japanese unexamined patent application publication No. 2005-155448 (JP2005-155448A). This intake manifold is provided with a plurality of intake pipes (branch pipes) for distributing intake air to a plurality of cylinders of an engine, and a chamber (an EGR gas distribution part) for distributing EGR gas to the branch pipes. The EGR gas distribution part is provided on top of and across the branch pipes so as to straddle over them and is formed integral with the intake manifold. The EGR gas distribution part is internally provided with a recess to allow EGR gas to accumulate therein and externally provided with a warm water passage, adjacent to the recess, to allow cooling water (warm water) in an engine to flow therethrough. Accordingly, part of the EGR gas flowing in the EGR gas distribution part accumulates in the recess. This accumulated EGR gas performs great heat exchange action with the warm water flowing through the warm water passage, so that the EGR gas in the EGR gas distribution part is kept warm. This can prevent the occurrence or freeze of condensed water in the EGR gas distribution part.

SUMMARY

Technical Problem

Meanwhile, the intake manifold disclosed in JP2005-155448A could efficiently keep warm the EGR gas in the EGR gas distribution part, but could not start exhaust gas recirculation (EGR) from an early stage during engine start-up under a cold condition, i.e. during cold start-up. This is because, at cold start-up, engine cooling water has not been warmed or heated yet to an appropriate temperature and thus could not warm or heat the EGR gas. In order to start EGR from an early stage during cold start-up, therefore, it is necessary to prevent the occurrence of condensed water and therefore warm an inner wall of the EGR gas distribution part from the early stage during cold start-up. For this purpose, an electric heater could be conceivably used to warm the inner wall of the EGR gas distribution part from an early stage during cold start-up. However, the intake manifold needs an additional electric structure and additional energy due to the heater, resulting in a complicated structure.

The present disclosure has been made to address the above problems and has a purpose to provide an intake manifold capable of warming an EGR gas distribution part from an early stage without needing additional structure and additional energy at cold start-up of an engine.

Means of Solving the Problem

To achieve the above-mentioned purpose, one aspect of the present disclosure provides an intake manifold comprising: a surge tank; a plurality of branch pipes branching off from the surge tank; an EGR gas distribution part for distributing EGR gas to each of the branch pipes; an EGR cooler configured to cool the EGR gas to be introduced into the EGR gas distribution part, the EGR cooler being provided adjacent to and integral with the EGR gas distribution part, and wherein the EGR cooler includes a gas passage through which the EGR gas flows and a water passage through which cooling water in an engine flows to cool the gas passage, the intake manifold is configured to allow the EGR gas to pass through the EGR cooler and then flow in the EGR gas distribution part.

According to the present disclosure, the intake manifold configured as above can warm an inner wall of an EGR gas distribution part from an early stage during cold start-up of an engine without additional structure and additional energy at cold start-up.

DETAILED DESCRIPTION OF THE EXEMPLARY EMBODIMENTS

A detailed description of an embodiment of an intake manifold which is one of typical embodiments of this disclosure will now be given referring to the accompanying drawings.

Figure 1:
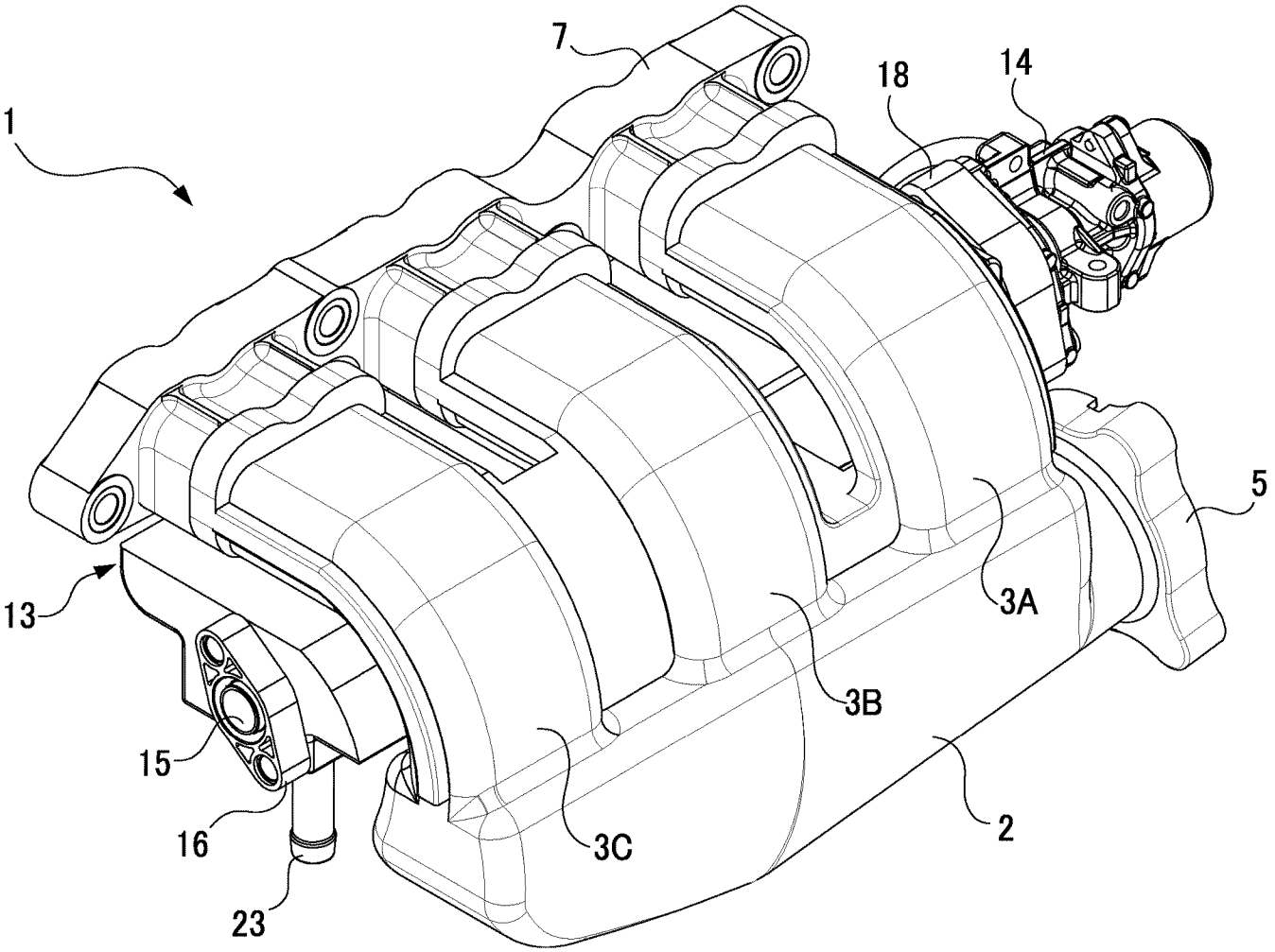
FIG. 1 is a perspective view showing a front side of an intake manifold in an embodiment.
Figure 2:
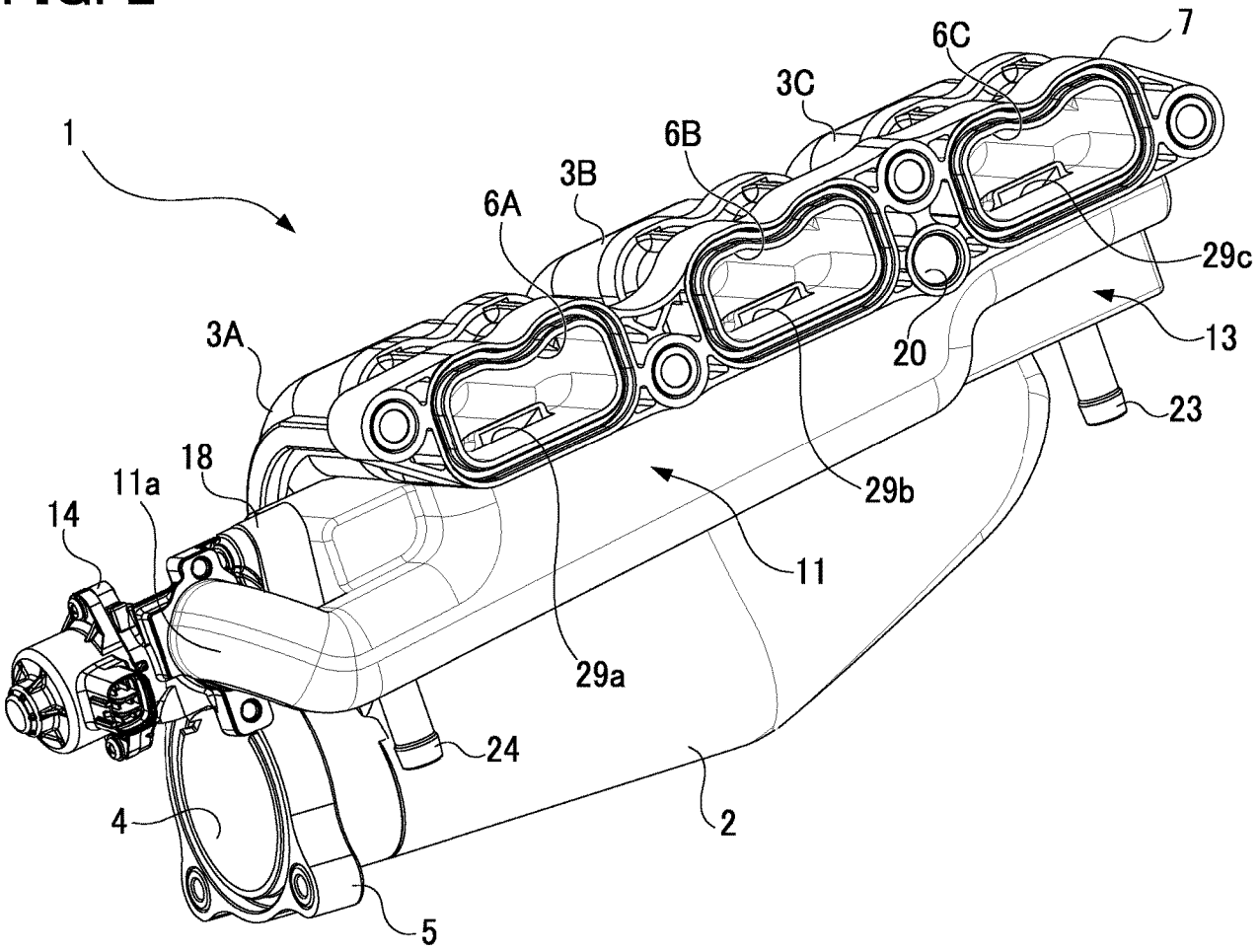
FIG. 2 is a perspective view showing a back side of the intake manifold in the embodiment.
Figure 3:
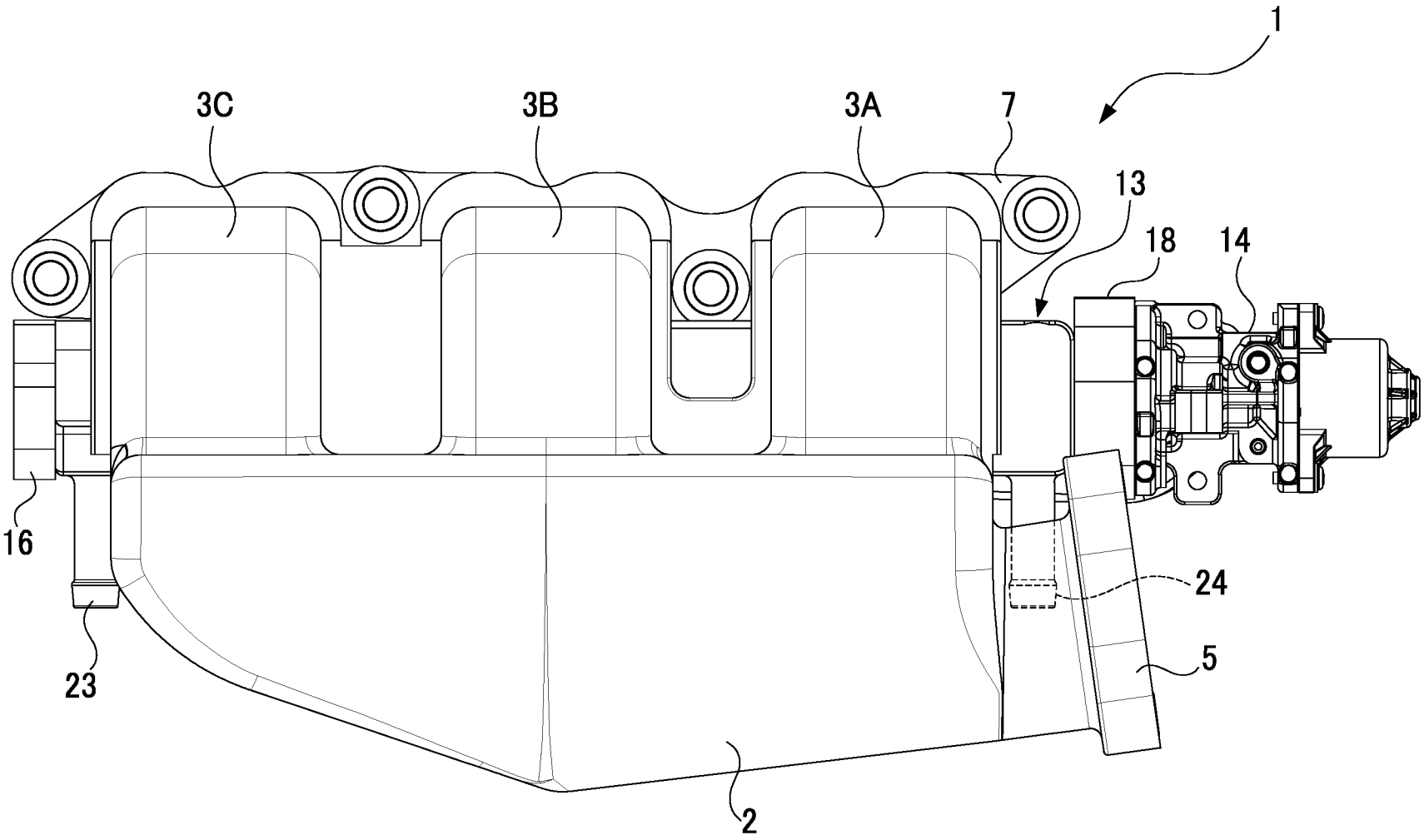
FIG. 3 is a front view of the intake manifold in the embodiment.
Figure 4:
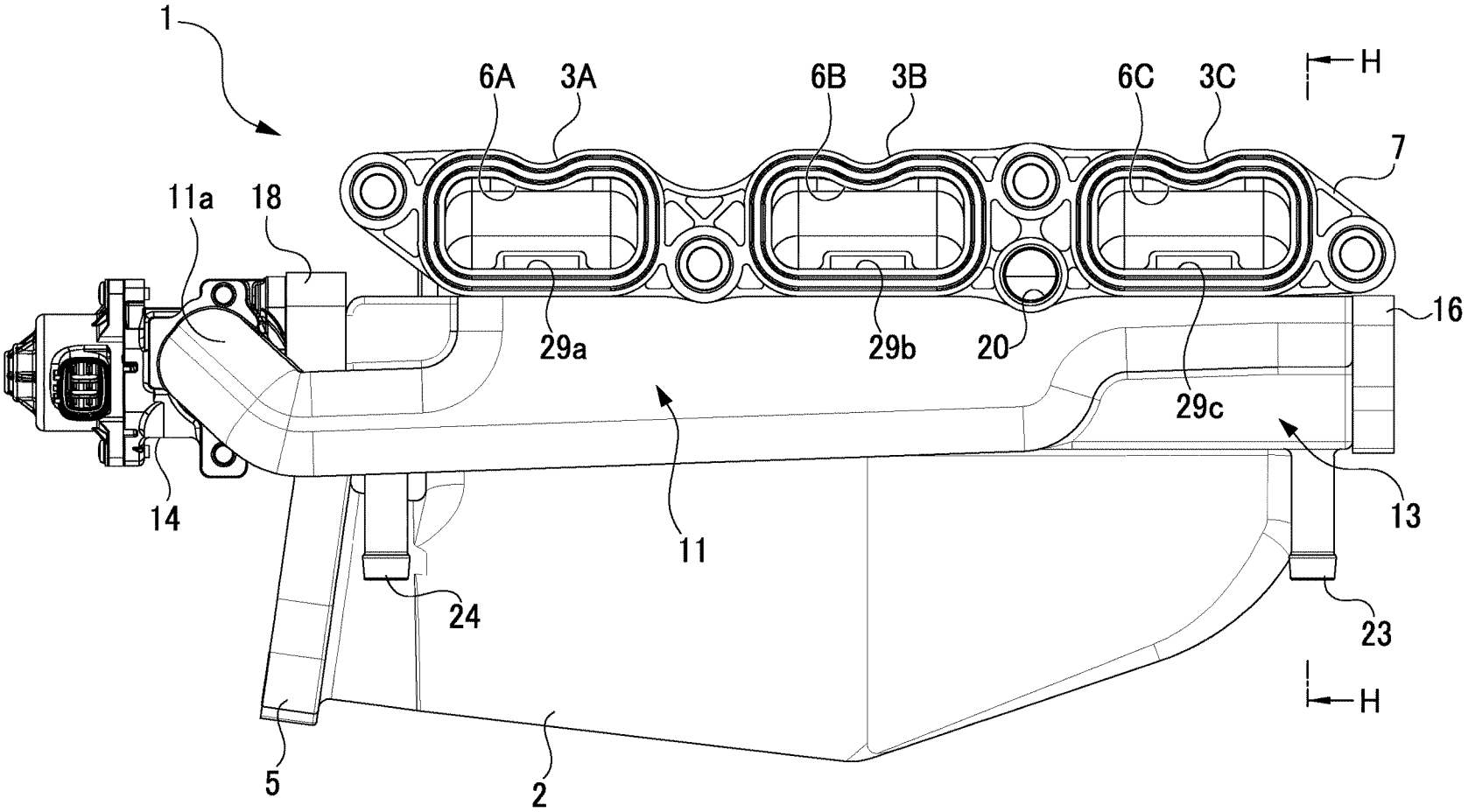
FIG. 4 is a back view of the intake manifold in the embodiment.
Figure 5:
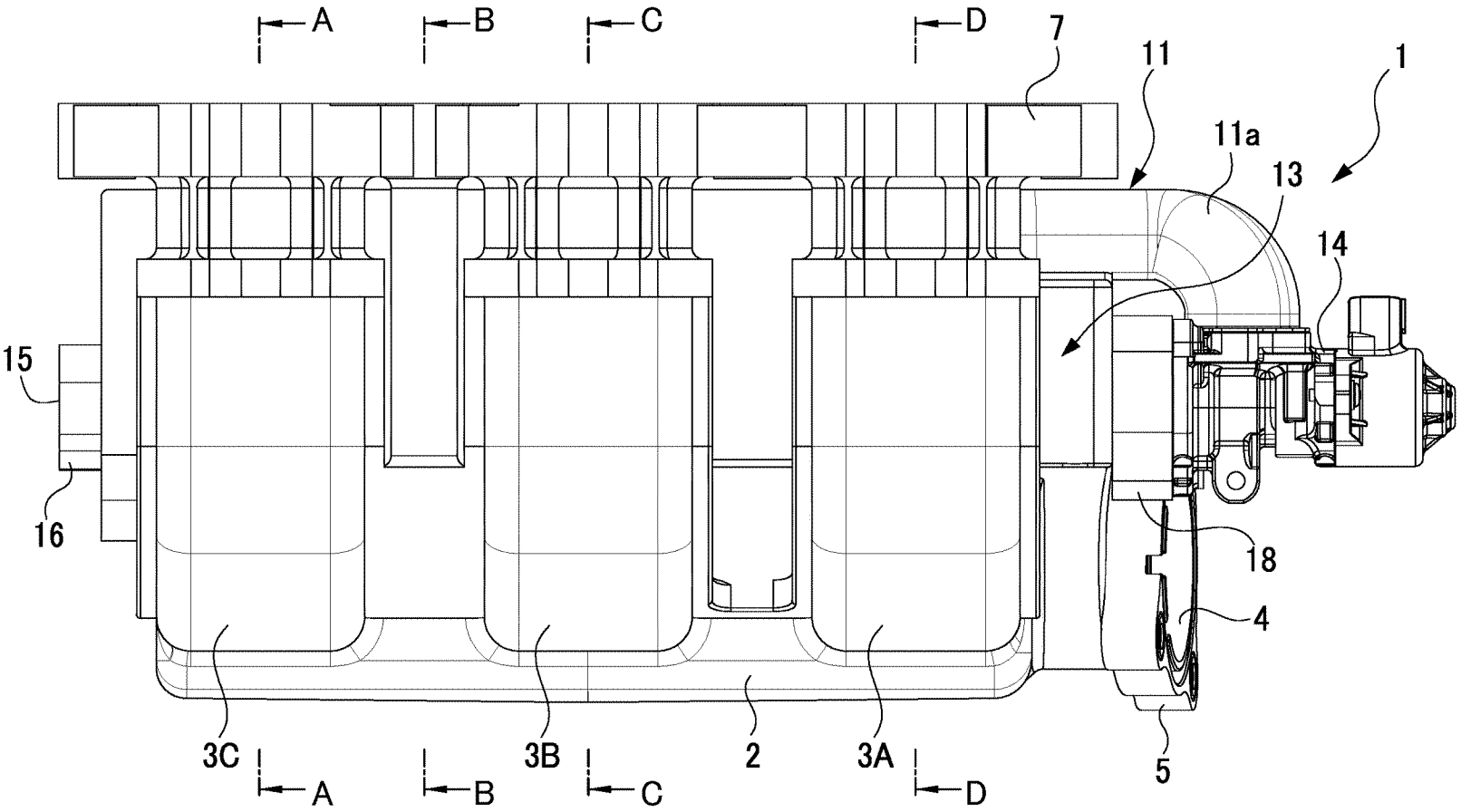
FIG. 5 is a plan view of the intake manifold in the embodiment.
Figure 6:
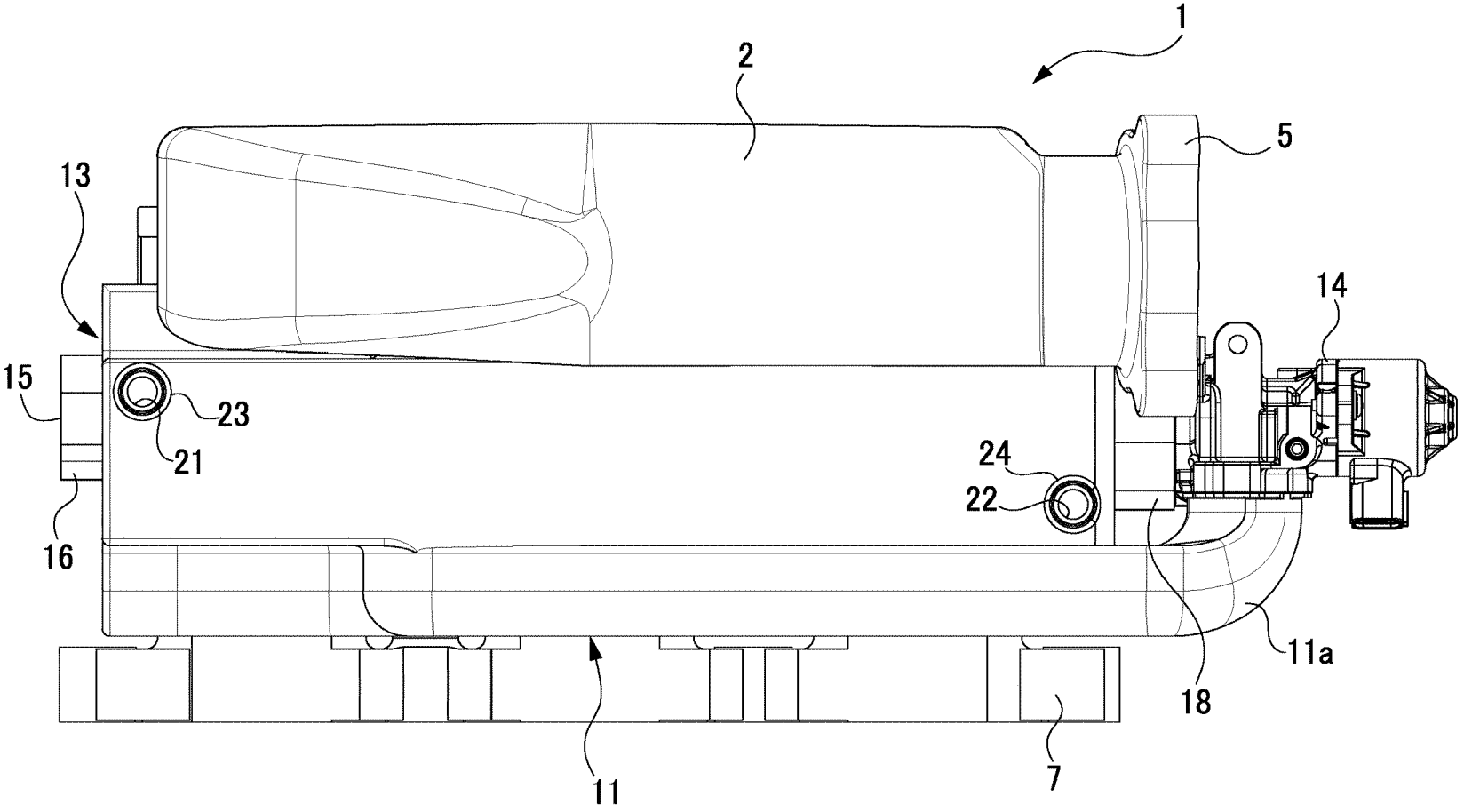
FIG. 6 is a bottom view of the intake manifold in the embodiment
Figure 7:
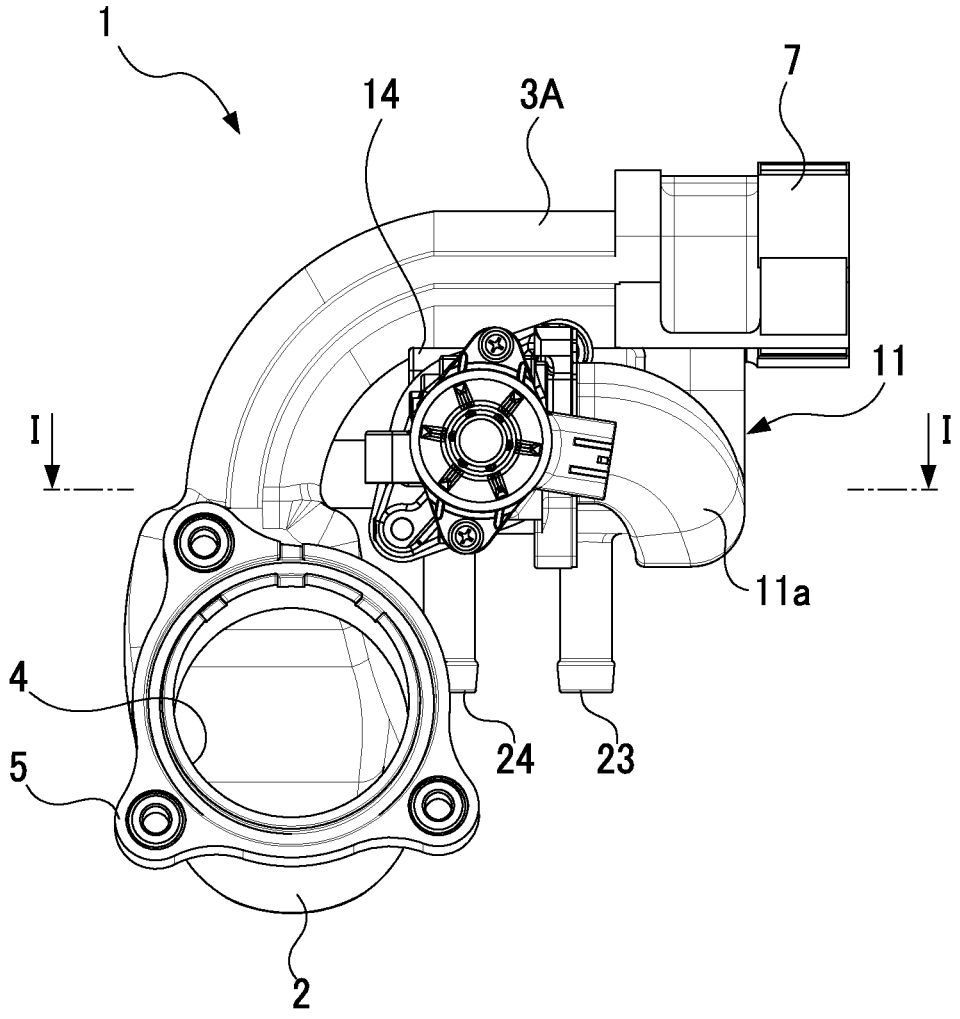
FIG. 7 is a right side view of the intake manifold in the embodiment.
Figure 8:
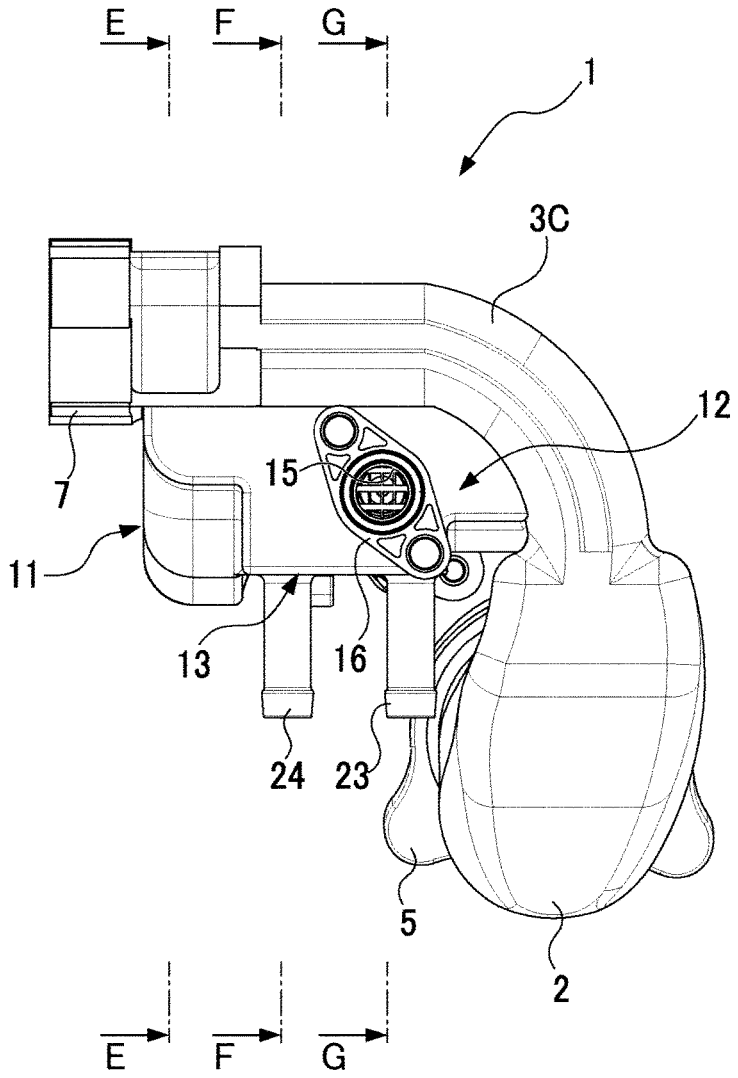
FIG. 8 is a left side view of the intake manifold in the embodiment.

FIG. 1 is a perspective view showing a front side of an intake manifold 1 in the present embodiment. FIG. 2 is a perspective view showing a back side of the intake manifold 1. FIG. 3 is a front view of the intake manifold 1. FIG. 4 is a back view of the intake manifold 1. FIG. 5 is a plan view of the intake manifold 1. FIG. 6 is a bottom view of the intake manifold 1. FIG. 7 is a right side view of the intake manifold 1. FIG. 8 is a left side view of the intake manifold 1. This intake manifold 1 oriented as shown in FIGS. 3 and 4 is actually mounted in an engine. Thus, the top and bottom of the intake manifold 1 is defined as illustrated in FIGS. 3 and 4. This intake manifold 1 is mounted in the engine in use to deliver intake air into a plurality of cylinders of the engine. The intake manifold 1 is entirely made of resin, or plastic, and is provided with a surge tank 2 and a plurality of branch pipes 3A, 3B, and 3C branching off from the surge tank 2. Those branch pipes 3A to 3C extend in a curve in the same direction from the surge tank 2 and in parallel with each other. In the present embodiment, the intake manifold 1 includes three branch pipes 3A to 3C corresponding to a three-cylinder engine. In the present embodiment, the intake manifold 1 may be made of e.g. water-resistant Polyphthalamide (PPA) resin.

The surge tank 2 is provided, as shown in FIGS. 1 to 8, with an intake inlet 4 through which intake air is drawn into the surge tank 2. The intake inlet 4 is provided on its outer circumference with an inlet flange 5 to which a well-known throttle device is connectable. A plurality of intake outlets 6A, 6B, and 6C are respectively provided at downstream ends of the branch pipes 3A to 3C to deliver intake air toward corresponding intake ports of the engine. The intake outlets 6A to 6C are provided on their outer circumference with an outlet flange 7 which is connectable to the engine.

Inside of a curved portion of each of the branch pipes 3A to 3C, as shown in FIGS. 1 to 8, there are provided gas distribution parts 11 and 12 for distributing gas to the branch pipes 3A to 3C and an EGR cooler 13 for cooling EGR gas and also warming the gas in the gas distribution parts 11 and 12 (particularly at cold start-up). In the present embodiment, the gas distribution parts 11 and 12 include an EGR gas distribution part 11 for distributing EGR gas to the branch pipes 3A to 3C and a PCV gas distribution part 12 for distributing PCV gas to the branch pipes 3A to 3C. The EGR gas is part of exhaust gas discharged from the engine and returned to the engine. The PCV gas is blowby gas leaked from the engine to a crank case. The EGR gas distribution part 11 and the PCV gas distribution part 12 are placed by interposing the EGR cooler 13 therebetween, i.e., located on opposite sides of the EGR cooler 13, and provided integral with the EGR cooler 13. The EGR gas distribution part 11, EGR cooler 13, and PCV gas distribution part 12 are placed in parallel with each other and extend across, or intersect, the branch pipes 3A to 3C. In the present embodiment, in the intake manifold 1 made of resin, the EGR gas distribution part 11, PCV gas distribution part 12, and EGR cooler 13 are integrally made of resin.

The EGR cooler 13 is provided, at one end in its longitudinal direction (a left end in FIGS. 1, 5, and 6) with an EGR gas inlet 15 for introducing EGR gas into the EGR cooler 13, as shown in FIGS. 1 to 8. The EGR gas inlet 15 is provided on its outer circumference with an inlet flange 16 to which a pipe of an EGR passage is connectable to allow EGR gas to flow in the EGR gas inlet 15. Further, the EGR cooler 13 is further provided, at the other end in its longitudinal direction (a right end in FIGS. 1, 5, and 6), with an EGR gas outlet 17 (see FIG. 15) for discharging the EGR gas out of the EGR cooler 13. The EGR gas outlet 17 is provided on its outer circumference with an outlet flange 18 to which an electrically operated EGR valve 14 is fixed to regulate a flow rate of the EGR gas. In the present embodiment, the EGR gas having flowed in the EGR cooler 13 is allowed to pass through the EGR cooler 13 and then flow in the EGR gas distribution part 11 through the EGR valve 14. A flow-path inlet 14*a* (see FIG. 15) of the EGR valve 14 is connected to the EGR gas outlet 17 of the outlet flange 18. A flow-path outlet 14*b* (see FIG. 14) of the EGR valve 14 is connected to an EGR gas inlet 19 (see FIGS. 13 and 14) of the EGR gas distribution part 11. Specifically, as shown in FIG. 2, the EGR gas distribution part 11 is provided, on its inlet side (a left side in FIG. 2), with a curved portion 11*a* in which the EGR gas inlet 19 is provided. This EGR gas inlet 19 communicates with the flow-path outlet 14*b* of the EGR valve 14.

The EGR cooler 13 is arranged to allow cooling water (or warm water) circulating through a cooling water passage of an engine to flow in. The EGR cooler 13 includes a cooling water inlet 21 at one end portion in the longitudinal direction and a cooling water outlet 22 at the other end portion in the longitudinal direction. The cooling water inlet 21 is provided in an inlet pipe joint 23 and the cooling water outlet 22 is provided in an outlet pipe joint 24. These inlet pipe joint 23 and outlet pipe joint 24 are connectable to corresponding pipes of cooling water passages of the engine. Though those pipes, cooling water (warm water) of the engine is allowed to flow in the EGR cooler 13.

Furthermore, as shown in FIGS. 2 and 4, a PCV gas inlet 20 is provided between two branch pipes 3B and 3C to introduce PCV gas into the PCV gas distribution part 12. The PCV gas inlet 20 is connectable to a pipe of a PCV passage through a PCV valve.

Figure 9:
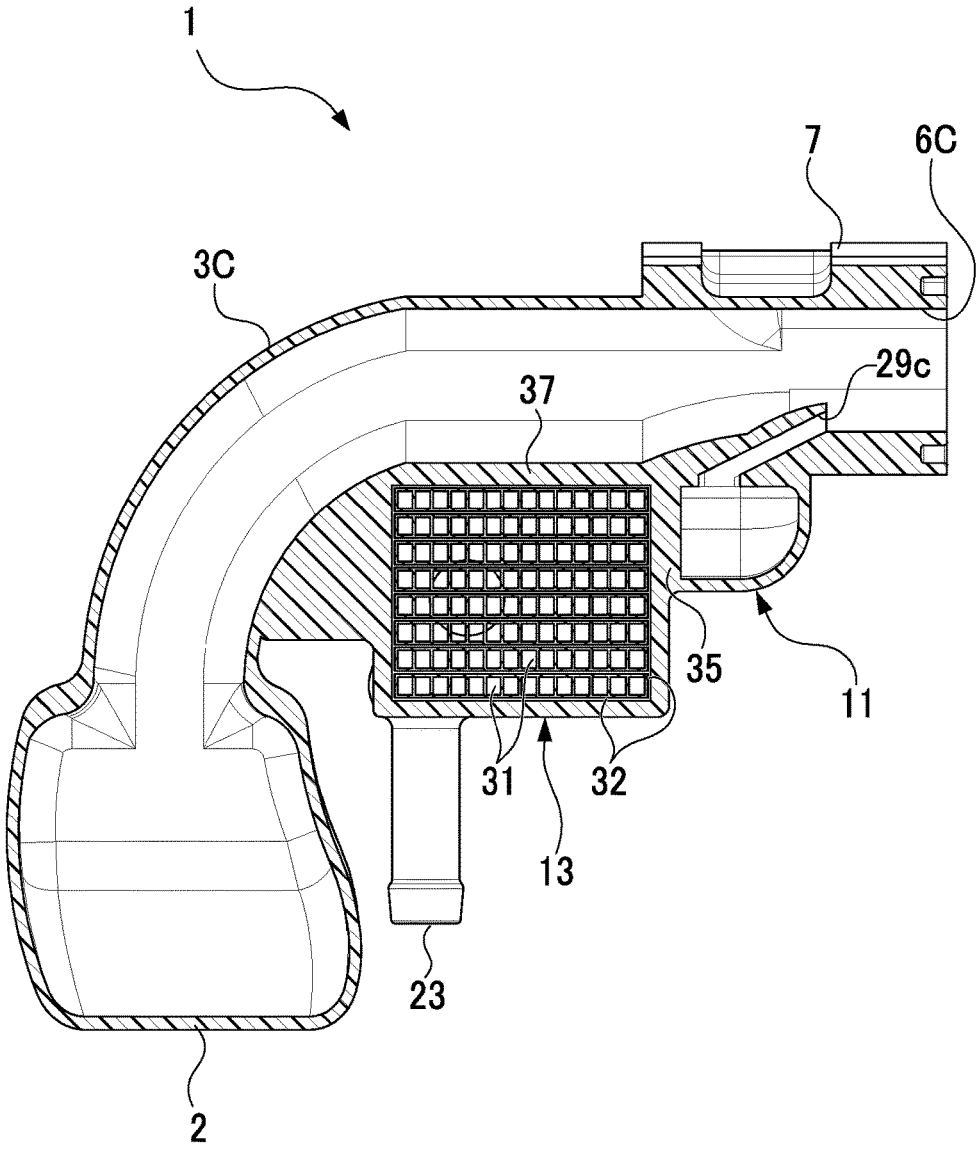
FIG. 9 is a cross-sectional view of the intake manifold taken along a line A-A in FIG. 5 in the embodiment.
Figure 10:
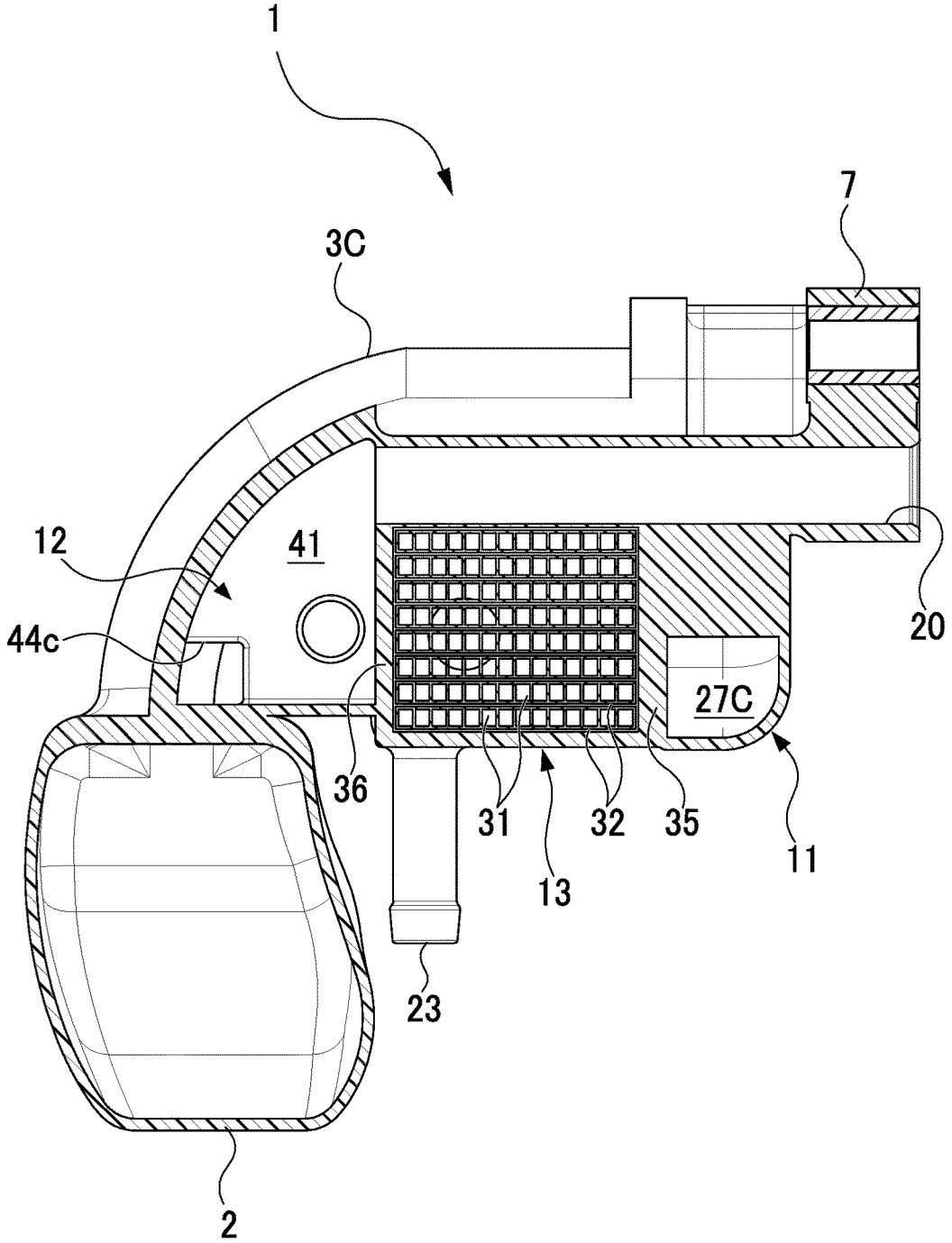
FIG. 10 is a cross-sectional view of the intake manifold taken along a line B-B in FIG. 5 in the embodiment.
Figure 11:
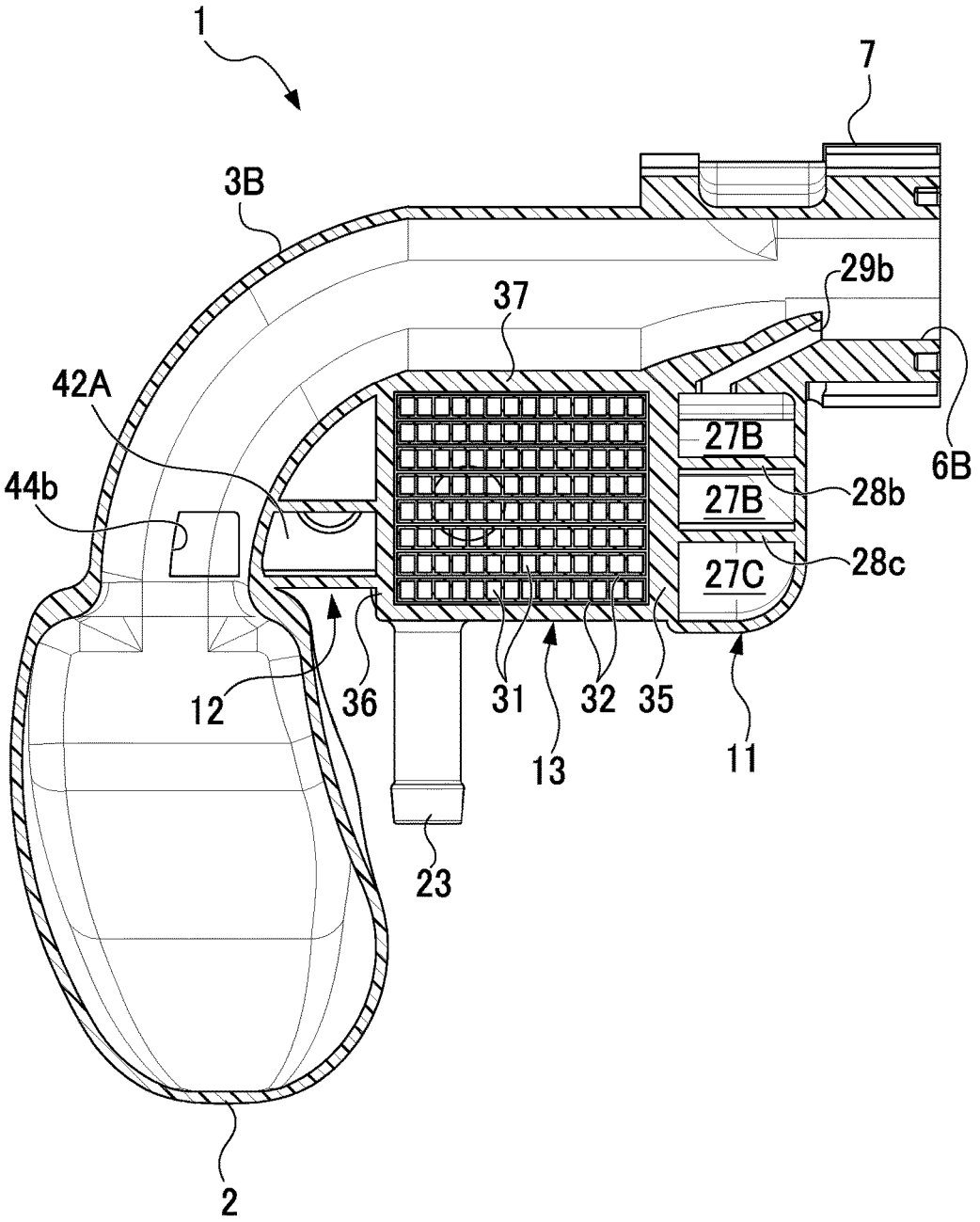
FIG. 11 is a cross-sectional view of the intake manifold taken along a line C-C in FIG. 5 in the embodiment.
Figure 12:
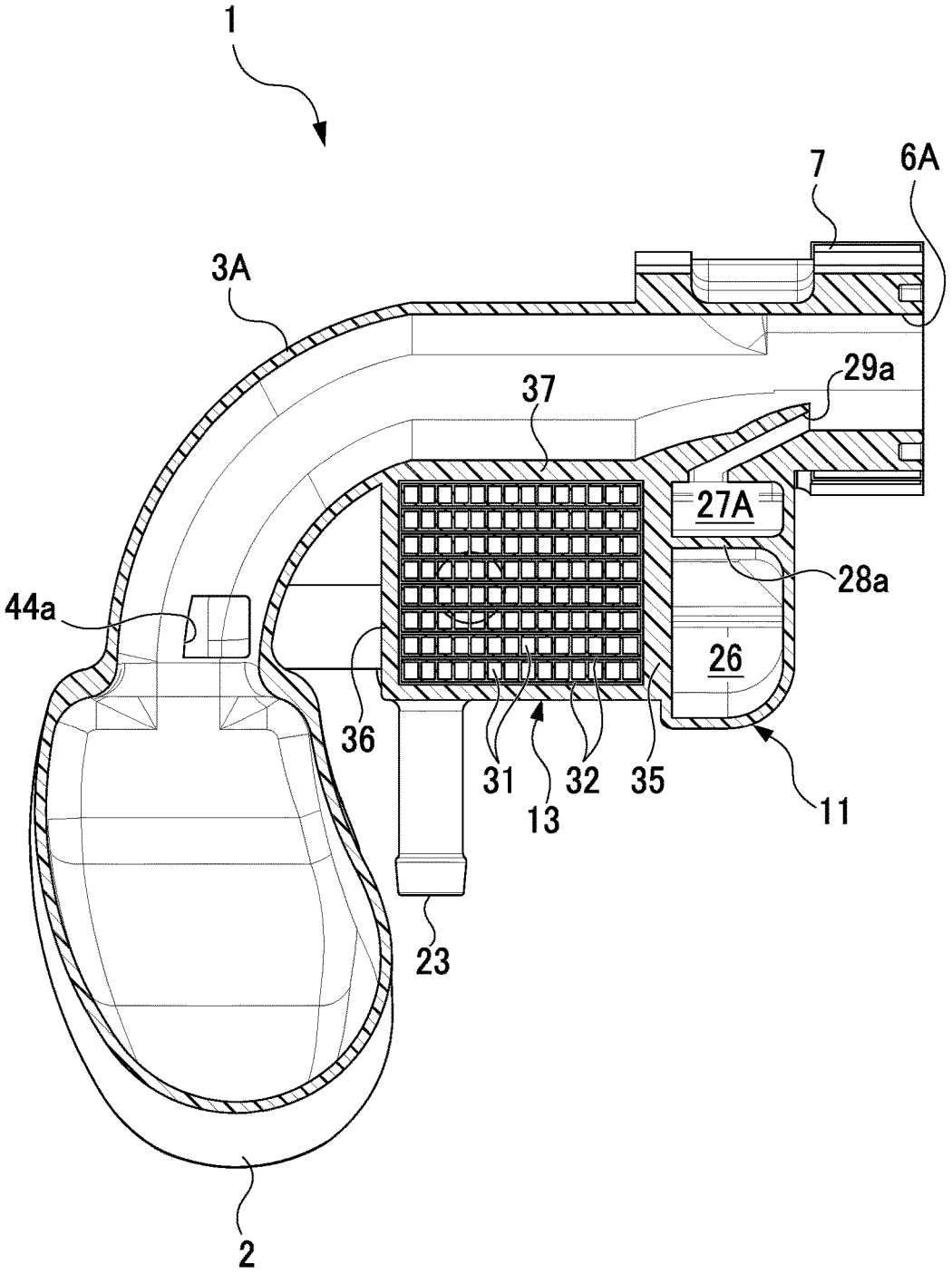
FIG. 12 is a cross-sectional view of the intake manifold taken along a line D-D in FIG. 5 in the embodiment.

FIG. 9 is a cross-sectional view of the intake manifold 1 taken along a line A-A in FIG. 5. FIG. 10 is a cross-sectional view of the intake manifold 1 taken along a line B-B in FIG. 5. FIG. 11 is a cross-sectional view of the intake manifold 1 taken along a line C-C in FIG. 5. FIG. 12 is a cross-sectional view of the intake manifold 1 taken along a line D-D in FIG. 5. As shown in FIGS. 9 to 12, the EGR cooler 13 and the branch pipes 3A to 3C are provided adjacent to and integral with each other through a wall 37. In the figures, specifically, the branch pipes 3A to 3C are adjacently located on the upper side of the EGR cooler 13. As seen from FIGS. 9 to 12, the EGR cooler 13 has a uniform cross sectional shape at different positions in its longitudinal direction and each of the EGR gas distribution part 11 and the PCV gas distribution part 12 has different cross sectional shapes at different positions in each longitudinal direction. In the present embodiment, their cross sectional shapes are explained below referring to FIG. 11 showing their typical shapes. The PCV gas distribution part 12 is placed closest to the surge tank 2 and the EGR gas distribution part 11 is placed closest to the outlet flange 7 of the branch pipes 3A to 3C, as shown in FIG. 11.

Figure 13:
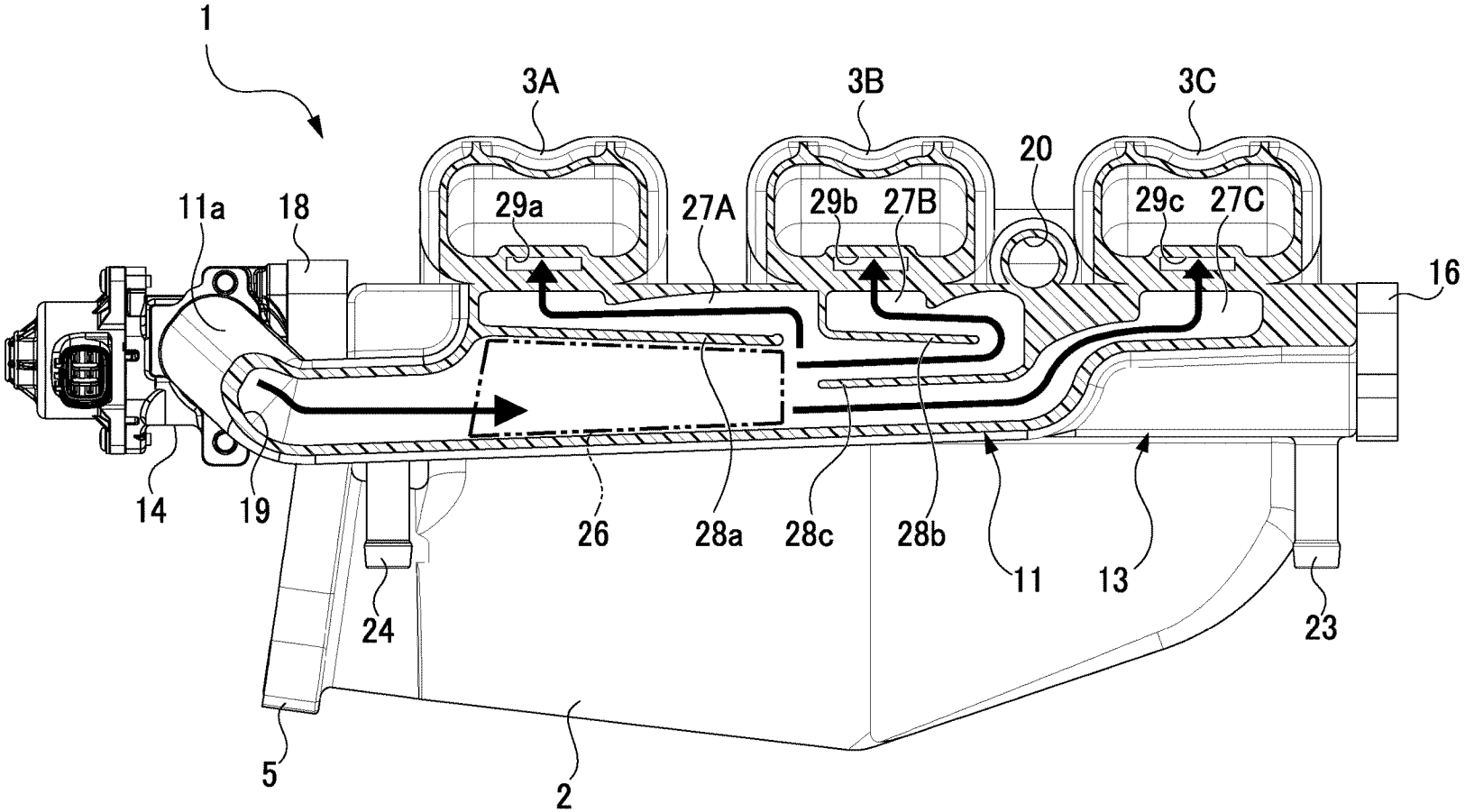
FIG. 13 is a cross-sectional view of an EGR gas distribution part taken along a line E-E in FIG. 8 in the embodiment.

FIG. 13 is a cross-sectional view of the EGR gas distribution part 11 taken along a line E-E in FIG. 8. As shown in FIG. 11, the EGR gas distribution part 11 has a nearly rectangular cross-sectional shape in a direction perpendicular to a longitudinal direction of the EGR gas distribution part 11. As shown in FIG. 13, the EGR gas distribution part 11 is internally provided with an EGR gas chamber 26 and three EGR gas distribution passages 27A, 27B, and 27C (indicated by different arrows) branching off from the EGR gas chamber 26. Specifically, the EGR gas chamber 26 allows streams of the EGR gas introduced into the EGR gas distribution part 11 through the EGR gas inlet 19 to collect once. The EGR gas distribution passages 27A, 27B, and 27C respectively communicate with the branch pipes 3A to 3C. The EGR gas chamber 26 and the EGR gas distribution passages 27A to 27C are partitioned by walls 28*a*, 28*b*, and 28*c*. The EGR gas distribution passages 27A to 27C are respectively provided, with their outlet sides, with nozzles 29*a*, 29*b*, and 29*c* communicated with the corresponding branch pipes 3A to 3C as shown in FIGS. 9 and 11 to 13. Accordingly, the EGR gas distribution part 11 allows the EGR gas collecting in the EGR gas chamber 26 to flow in each of the EGR gas distribution passages 27A to 27C and then into the branch pipes 3A to 3C through the corresponding nozzles 29*a* to 29*c*.

Figure 14:
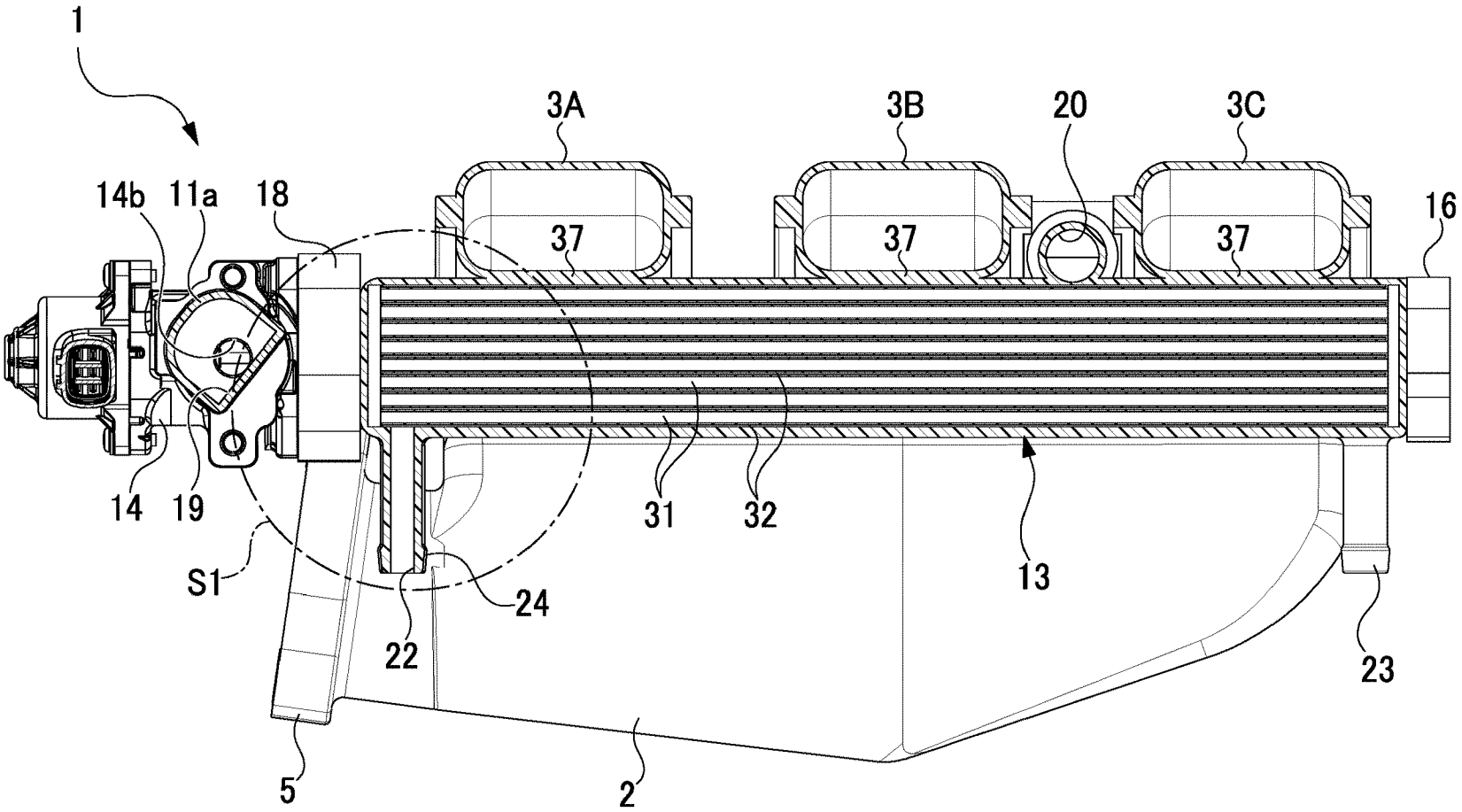
FIG. 14 is a cross-sectional view of an EGR cooler taken along a line F-F of FIG. 8 in the embodiment.
Figure 15:
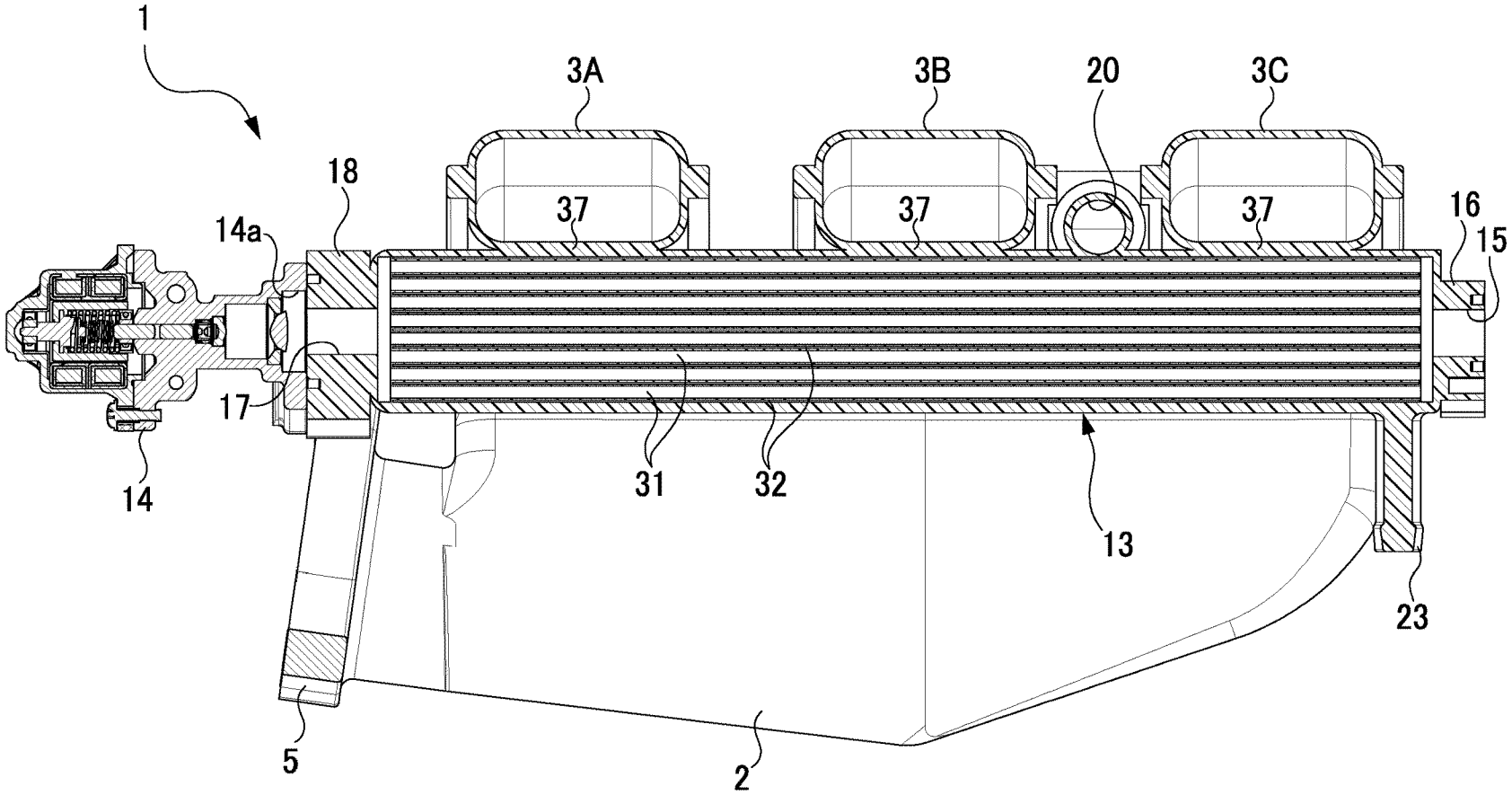
FIG. 15 is a cross-sectional view of the EGR cooler taken along a line G-G in FIG. 8 in the embodiment.
Figure 16:
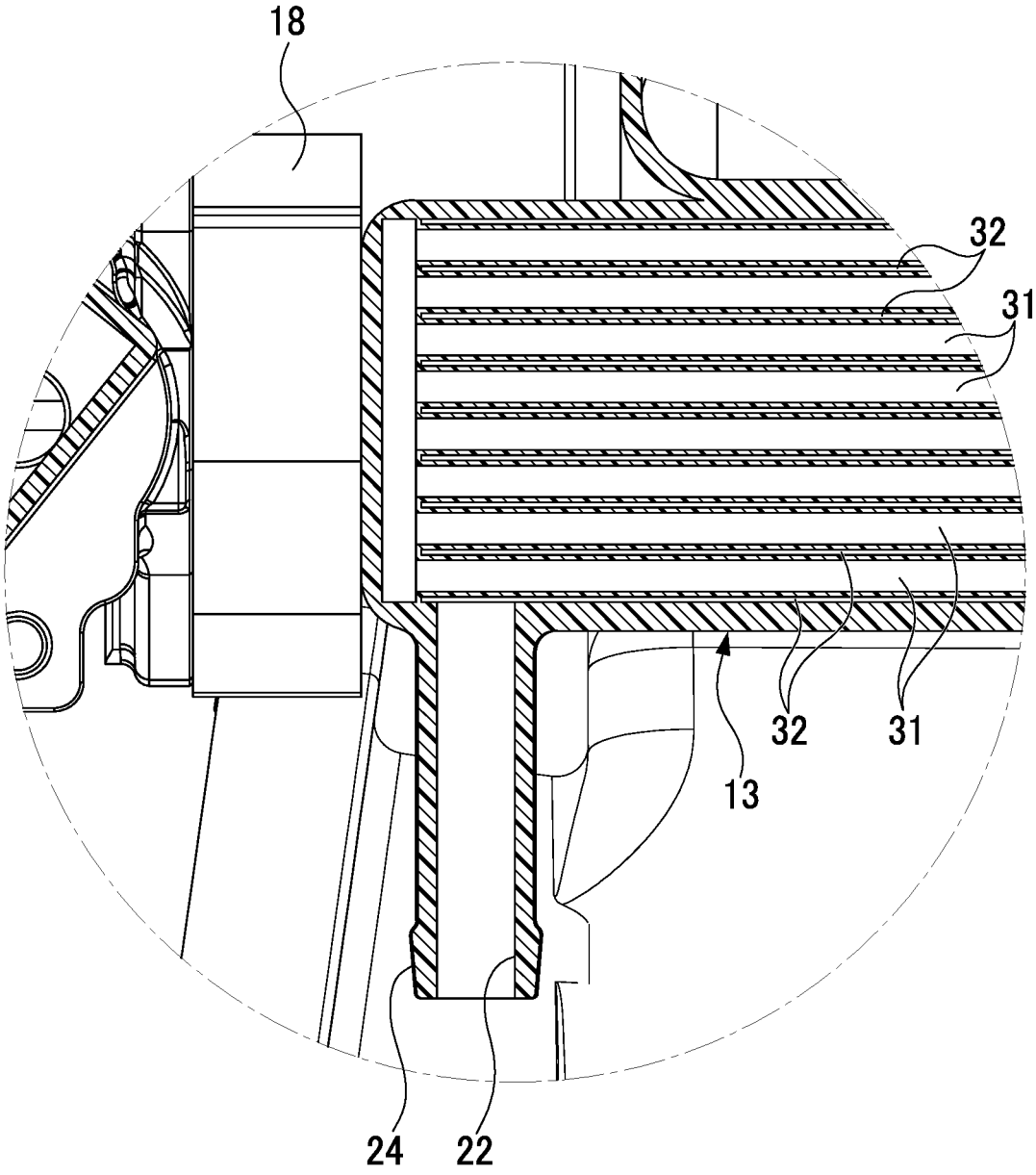
FIG. 16 is an enlarged cross-sectional view of a part circled with a chain-line circle in FIG. 14 in the embodiment.
Figure 17:
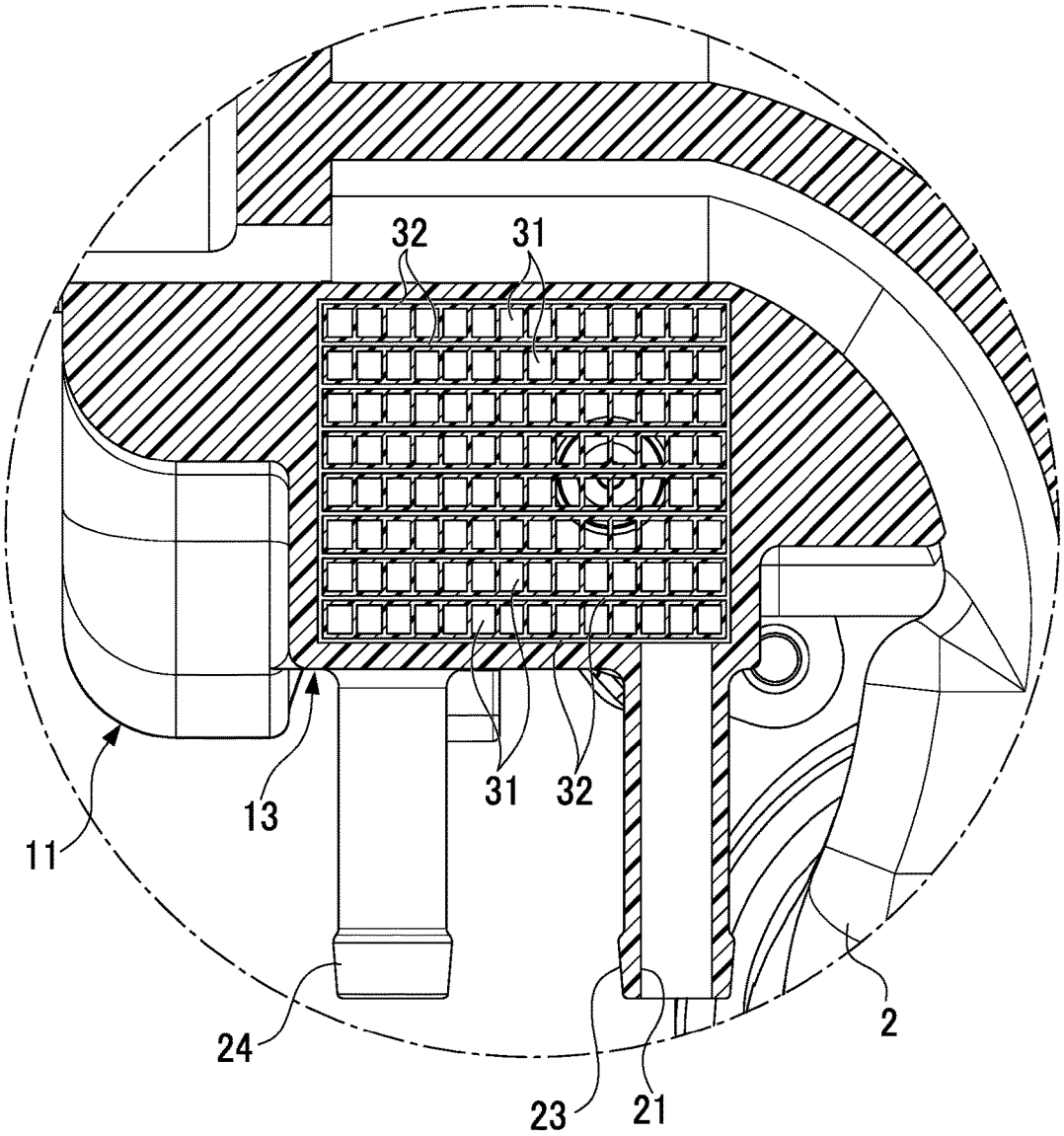
FIG. 17 is an enlarged cross-sectional view of a part of a cross section taken along an H-H in FIG. 4 in the embodiment.

FIG. 14 is a cross-sectional view of the EGR cooler 13 taken along a line F-F in FIG. 8. FIG. 15 is a cross-sectional view of the EGR cooler 13 taken along a line G-G in FIG. 8. FIG. 16 is an enlarged cross-sectional view showing a part circled with a chain-line circle S1 in FIG. 14. FIG. 17 is an enlarged cross-sectional view of a part of the cross section taken along a line H-H in FIG. 4. As shown in FIGS. 14 and 15, the EGR cooler 13 extends in the longitudinal direction so as to intersect the branch pipes 3A to 3C. The EGR cooler 13 has, as shown in FIG. 11, a cross section perpendicular to the longitudinal direction having a rectangular shape including two opposite sides (a right side and a left side in the figures) on which the EGR gas distribution part 11 and the PCV gas distribution part 12 are arranged adjacent to the EGR cooler 13. These two opposite sides are formed by walls 35 and 36. As shown in FIGS. 9 to 12 and 14 to 17, the EGR cooler 13 is internally provided with a plurality of gas passages 31 through which EGR gas flows and a plurality of water passages 32 through which cooling water flows. The gas passages 31 extend in a bundle in the longitudinal direction. Each of the gas passages 31 is formed of a pipe having a rectangular cross section. As shown in FIG. 15, one end of each gas passage 31 communicates with the EGR gas inlet 15, while the other end communicates with the EGR gas outlet 17. In contrast, each of the water passages 32 is formed between adjacent two of the gas passages 31 or along each gas passage 31. The water passages 32 communicate with the cooling water inlet 21 at one end portion and the cooling water outlet 22 at the other end portion of the EGR cooler 13 as shown in FIGS. 16 and 17. Thus, the EGR gas flowing in the EGR cooler 13 through the EGR gas inlet 15 is allowed to flow through the gas passages 31, passing through the EGR valve 14 through the EGR gas outlet 17, and then flow in the EGR gas distribution parts 11 via the curved portion 11*a*. The cooling water flowing in the EGR cooler 13 through the cooling water inlet 21 is allowed to flow through the water passages 32 and then flow in the cooling water passage of the engine through the cooling water outlet 22.

As shown in FIG. 11, the EGR gas distribution part 11 and the EGR cooler 13 are partitioned by the wall 35. Specifically, the EGR gas chamber 26 and the EGR gas distribution passages 27A to 27C in the EGR gas distribution part 11 are placed adjacent to the EGR cooler 13 through the wall 35 and formed integral with the EGR cooler 13. Furthermore, the PCV gas distribution part 12 and the EGR cooler 13 are partitioned by the wall 36 as shown in FIG. 11. In the present embodiment, the walls 35 and 36 may be made of a material having higher thermal conductivity than a material forming other portions of the EGR cooler 13. For instance, such a high thermal conductive material can be made of resin mixed with carbon powder.

Figure 18:
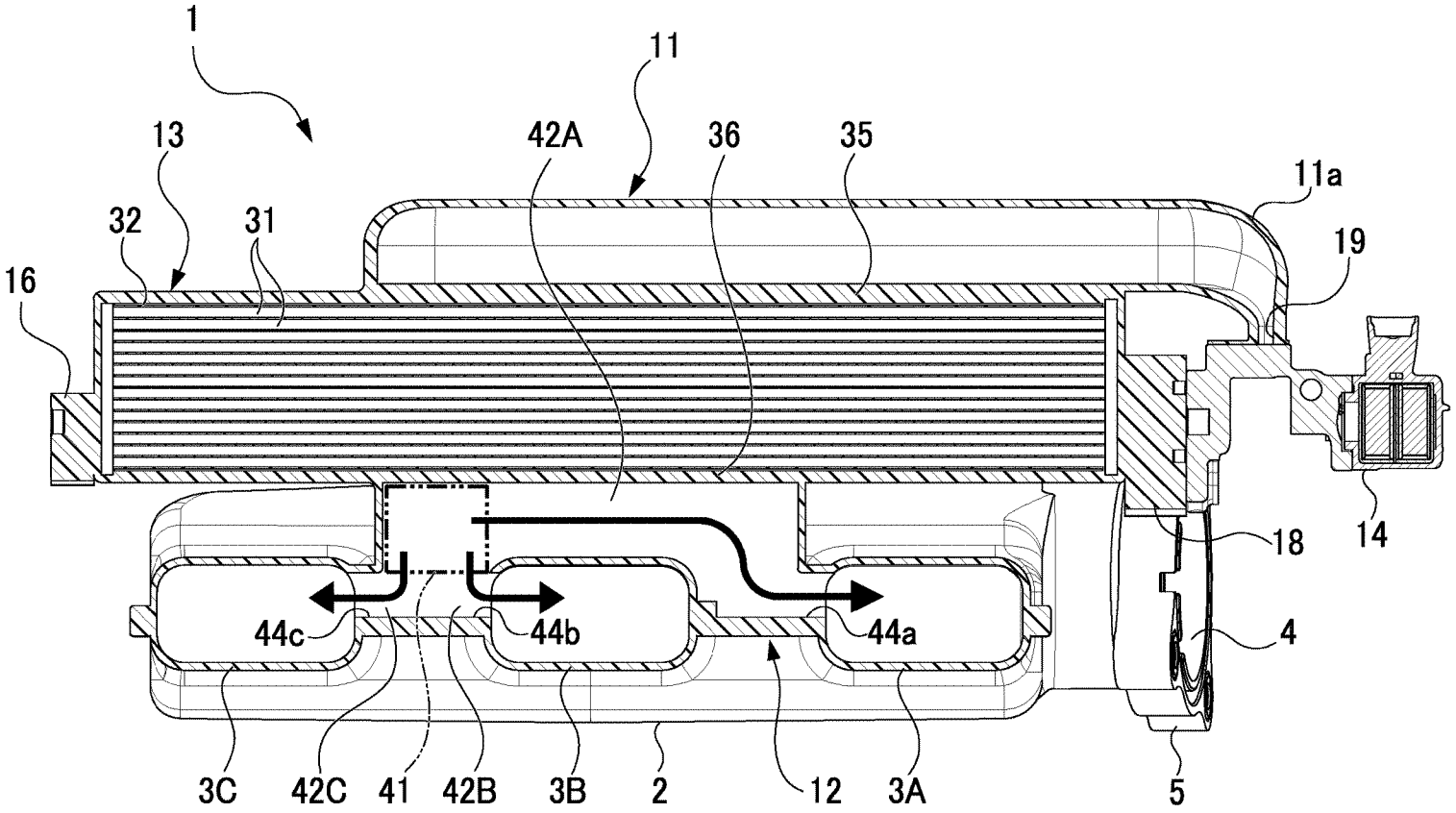
FIG. 18 is a cross-sectional view of a PCV gas distribution part taken along a line I-I in FIG. 7 in the embodiment.

FIG. 18 is a cross-sectional view of the PCV gas distribution part 12 taken along a line I-I in FIG. 7. As shown in FIGS. 10 and 11, the PCV gas distribution part 12 has an odd-shaped cross section perpendicular to the longitudinal direction. This PCV gas distribution part 12 is placed so that one side (a right side in FIGS. 10 and 11) of the odd-shaped cross section is adjacent to the EGR cooler 13. As shown in FIGS. 10 and 18, inside the PCV gas distribution part 12, there are provided a PCV gas chamber 41 and three PCV gas distribution passages 42A, 42B, and 42C (indicated by different arrows). The PCV gas chamber 41 communicates with the PCV gas inlet 20 and allows streams of PCV gas to collect once. The PCV gas distribution passages 42A to 42C branching off from the PCV gas chamber 41 respectively communicate with the branch pipes 3A to 3C. Those PCV gas chamber 41 and PCV gas distribution passages 42A to 42C are placed adjacent to the EGR cooler 13 through the wall 36 and provided integral with the EGR cooler 13. As shown in FIGS. 10 to 12 and 18, the PCV gas distribution passages 42A to 42C are provided, at respective outlets, with communication holes 44*a*, 44*b*, and 44*c* which respectively communicate with the branch pipes 3A, 3B, and 3C. Thus, the PCV gas having flowed in the PCV gas distribution part 12 through the PCV gas inlet 20 and collected in the PCV gas chamber 44 flows in the PCV gas distribution passages 42A to 42C and therefrom to the corresponding branch pipes 3A to 3C.

According to the structure of the intake manifold 1 in the present embodiment described above, while the intake manifold 1 is mounted in the engine, at cold start-up of the engine, low-temperature engine cooling water flows through the water passages 32 of the EGR cooler 13. Further, the EGR gas flowing in the EGR cooler 13 passes through the gas passages 31 and then flows in the EGR gas distribution part 11 through the EGR valve 14. This EGR gas is then distributed to the branch pipes 3A to 3C. In the present embodiment, the EGR cooler 13 and the EGR gas distribution part 11 are provided adjacently as one unit. To be concrete, the EGR gas chamber 26 and the EGR gas distribution passages 27A to 27C of the EGR gas distribution part 11 are provided adjacent to and integral with the EGR cooler 13 through the wall 35. Accordingly, the heat of EGR gas flowing through the gas passages 31 of the EGR cooler 13 is transferred quickly to the inner wall of the EGR gas distribution part 11 which also constitutes the inner walls of the EGR gas chamber 26 and the EGR gas distribution passages 27A to 27C. This heat can warm the inner wall of the EGR gas distribution part 11 (which also constitutes the inner walls of the EGR gas chamber 26 and the EGR gas distribution passages 27A to 27C) from an early stage during cold start-up of the engine without needing additional structure such as an electric heater or additional energy such as electric power during the cold start-up. Consequently, the intake manifold 1 configured as above can prevent the occurrence of condensed water on the inner wall of the EGR gas distribution part 11 and start EGR from an early stage during cold start-up.

According to the structure in the present embodiment, the wall 35 separating the EGR gas distribution part 11 and the EGR cooler 13 from each other is made of a material having higher thermal conductivity than a material forming other portions of the intake manifold 1. Thus, the heat of EGR gas flowing through the EGR cooler 13 is readily transferred to the inner wall of the EGR gas distribution part 11. This heat can further effectively warm the inner wall of the EGR gas distribution part 11 from an early stage during cold start-up.

According to the structure in the present embodiment, since the EGR cooler 13 and the PCV gas distribution part 12 are provided adjacently and integrally, the heat of EGR gas flowing through the gas passages 31 of the EGR cooler 13 is quickly transferred to the inner wall of the PCV gas distribution part 12. This heat can warm the inner wall of the PCV gas distribution part 12 from an early stage during cold start-up.

According to the structure in the present embodiment, the wall 36 separating the EGR gas distribution part 11 and the PCV gas distribution part 12 from each other is made of a material having higher thermal conductivity than a material forming other portions of the intake manifold 1. Thus, the heat of EGR gas flowing through the EGR cooler 13 is readily transferred to the inner wall of the PCV gas distribution part 12. This heat can further effectively warm the inner wall of the PCV gas distribution part 12 from an early stage during cold start-up.

In addition, according to the structure in the present embodiment, since the EGR cooler 13 and the branch pipes 3A to 3C are provided adjacently and integrally through the wall 37, the heat of EGR gas flowing through the gas passage of the EGR cooler 13 is quickly transferred to the inner walls of the branch pipes 3A to 3C. This heat can warm the inner walls of the branch pipes 3A to 3C from an early stage during cold start-up without needing additional structure or additional energy. Consequently, the intake manifold 1 can prevent the occurrence of condensed water on the inner walls of the branch pipes 3A to 3C and hence start EGR from an early stage during cold start-up.

According to the structure in the present embodiment, since the EGR gas distribution part 11, the PCV gas distribution part 12, and the EGR cooler 13 are placed inside the curved branch pipes 3A to 3C, these parts 11 to 13 do not protrude outside the intake manifold 1. Thus, the intake manifold 1 can achieve size reduction and provide improved ease of installing to the engine and ease of mounting in a vehicle.

The present disclosure is not limited to the aforementioned embodiment and may be embodied in other specific forms without departing from the essential characteristics of the present disclosure.

Figure 19:
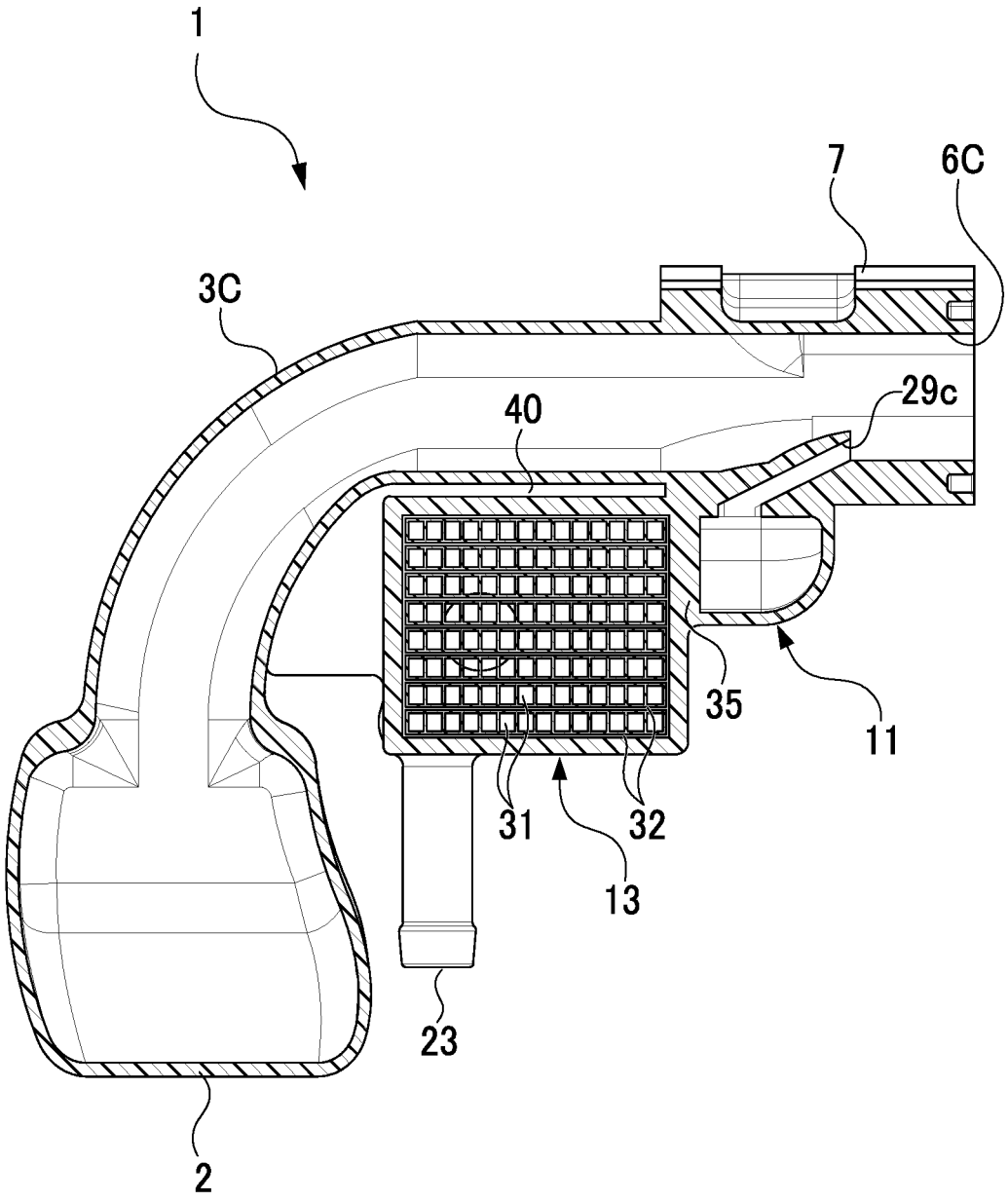
FIG. 19 is a cross-sectional view of an intake manifold in another embodiment, corresponding to FIG. 9.

In the aforementioned embodiment, as shown in FIG. 9, the EGR cooler 13 and the branch pipes 3A to 3C are provided through the wall 37. As an alternative, as shown in FIG. 19, the EGR cooler 13 and the branch pipes 3A to 3C may be separated by a gap 40. In this case, the heat of EGR gas and cooling water (warm water) flowing through the EGR cooler 13 is less transferred to the branch pipes 3A to 3C. This configuration can prevent intake air to be aspirated in an engine through the branch pipes 3A to 3C from being unnecessarily warmed to high temperatures by the heat of EGR gas and warm water after start-up of the engine. FIG. 19 is a cross sectional view corresponding to FIG. 9.

In the aforementioned embodiment, the EGR cooler 13 is entirely made of the same resin (e.g. PPA) as the material forming the intake manifold 1 and formed integral with the intake manifold 1. As an alternative, only a gas passage of an EGR cooler may be made of metal (e.g. stainless steel, such as SUS in JIS) and insert-molded in the EGR cooler which is integral with the intake manifold. As another alternative, an EGR cooler made of metal (e.g. stainless steel, such as SUS in JIS) may be integrally adhered to or insert-molded in an intake manifold made of resin (e.g. PA).

In the aforementioned embodiment, the wall 35 interposed between the EGR gas distribution part 11 and the EGR cooler 13 and the wall 36 interposed between the PCV gas distribution part 12 and the EGR cooler 13 are made of a higher thermal conductive material than a material forming other portions of the intake manifold 1. These walls 35 and 36 may also be made of a material having the same thermal conductivity as the material forming other portions.

In the aforementioned embodiment, the disclosure is embodied by the intake manifold 1 provided with three branch pipes 3A to 3C. However, the number of branch pipes also may be any plural number other than three.

Although the aforementioned embodiment does not disclose a detailed structure of the intake manifold 1, the intake manifold also may be formed of a plurality of pieces bonded as one integral component. Furthermore, the intake manifold also may be made of any material other than resin.

INDUSTRIAL APPLICABILITY

The present disclosure is utilizable as a component of an intake system in various types of engines.

REFERENCE SIGNS LIST

1 Intake manifold
2 Surge tank
3A Branch pipe
3B Branch pipe
3C Branch pipe
11 EGR gas distribution part
12 PCV gas distribution part
13 EGR cooler
19 EGR gas inlet
26 EGR gas chamber
27A EGR gas distribution passage
27B EGR gas distribution passage
27C EGR gas distribution passage
31 Gas passage
32 Water passage
35 Wall
36 Wall
37 Wall
40 Gap

What is claimed is:

1. An intake manifold comprising:

a surge tank;

a plurality of branch pipes branching off from the surge tank;

an EGR gas distribution part for distributing EGR gas to each of the branch pipes;

an EGR cooler configured to cool the EGR gas to be introduced into the EGR gas distribution part, the EGR cooler and the EGR gas distribution part being provided adjacent to and integral with each other outside the surge tank and the plurality of branch pipes; and an EGR valve configured to regulate a flow rate of the EGR gas to be introduced into the EGR gas distribution part through the EGR valve after the EGR gas having flowed in the EGR cooler passes through the EGR cooler, wherein the EGR cooler includes a gas passage through which the EGR gas flows and a water passage through which cooling water in an engine flows to cool the gas passage, and the intake manifold is configured to allow the EGR gas to pass through the EGR cooler and then flow in the EGR gas distribution part through the EGR valve, and distribute the EGR gas into the plurality of branch pipes so that the EGR gas merges with intake air that flows through the branch pipes.

2. The intake manifold according to claim 1, wherein the EGR gas distribution part is provided extending across the branch pipes, and the EGR gas distribution part includes:

an EGR gas inlet for introducing the EGR gas into the EGR gas distribution part;

an EGR gas chamber for allowing the EGR gas introduced through the EGR gas inlet to collect; and a plurality of EGR gas distribution passages branching off from the EGR gas chamber and individually communicating with the branch pipes, and the EGR gas chamber and the EGR gas distribution passages are provided adjacent to and integral with the EGR cooler.

3. The intake manifold according to claim 1, further including a PCV gas distribution part for distributing PCV gas to each of the branch pipes, wherein the PCV gas distribution part is provided adjacent to and integral with the EGR cooler.

4. The intake manifold according to claim 2, further including a PCV gas distribution part for distributing PCV gas to each of the branch pipes, wherein the PCV gas distribution part is provided adjacent to and integral with the EGR cooler.

5. The intake manifold according to claim 3, wherein the EGR gas distribution part and the PCV gas distribution part are placed by interposing the EGR cooler and provided integral with the EGR cooler.

6. The intake manifold according to claim 1, wherein the EGR cooler and the branch pipes are provided adjacently through a wall.

7. The intake manifold according to claim 2, wherein the EGR cooler and the branch pipes are provided adjacently through a wall.

8. The intake manifold according to claim 1, wherein the EGR cooler and the branch pipes are separated by a gap.

9. The intake manifold according to claim 2, wherein the EGR cooler and the branch pipes are separated by a gap.

* * * * *